United States Patent [19]

Hoshino

[11] Patent Number: 4,846,040

[45] Date of Patent: Jul. 11, 1989

[54] SPRING TENSION ADJUSTMENT AND INDICATOR FOR A HIGH HAT STAND

[75] Inventor: Yoshihiro Hoshino, Nagoya, Japan

[73] Assignee: Hoshino Gakki Co., Ltd., Japan

[21] Appl. No.: 218,948

[22] Filed: Jul. 13, 1988

[30] Foreign Application Priority Data

Mar. 31, 1988 [JP] Japan ..... 63-43850[U]

[51] Int. Cl.[4] ..... G10D 13/06

[52] U.S. Cl. ..... 84/422.1

[58] Field of Search ..... 84/422

[56] References Cited

U.S. PATENT DOCUMENTS

| | | | |
|---|---|---|---|
| 3,147,661 | 9/1964 | Padera | 84/422 |
| 3,530,757 | 9/1970 | Osuga | 84/422 |
| 4,145,951 | 3/1979 | Kobayashi | 84/422 R |
| 4,188,853 | 2/1980 | Bills | 84/422 R |
| 4,449,440 | 5/1984 | Hoshino | 84/422 R |
| 4,517,876 | 5/1985 | Duhon | 84/422 R |
| 4,667,562 | 5/1987 | Lee | 84/422 R |

*Primary Examiner*—Lawrence R. Franklin

*Attorney, Agent, or Firm*—Ostrolenk, Faber, Gerb & Soffen

[57] ABSTRACT

High hat spring tension adjustment mechanism including a spring biased shaft for operating a cymbal, a vertically relatively movable inner tube around the shaft, a spring connected between the shaft and the inner tube variable in spring tension with shifting of the inner tube and a stationary outer tube around the inner tube. Engagement members at the inner tube extend out through slots in the outer tube. Raising or lowering of the engagement members adjusts the spring tension. The outer tube supports an adjustment member for adjusting the height of the engagement members extending from the inner tube. Steps on the adjustment members adjust the height of the engagement members which adjusts the spring tension on the shaft. The height of the engagement members also provides a visible indication of the spring tension on the operating rod.

12 Claims, 4 Drawing Sheets

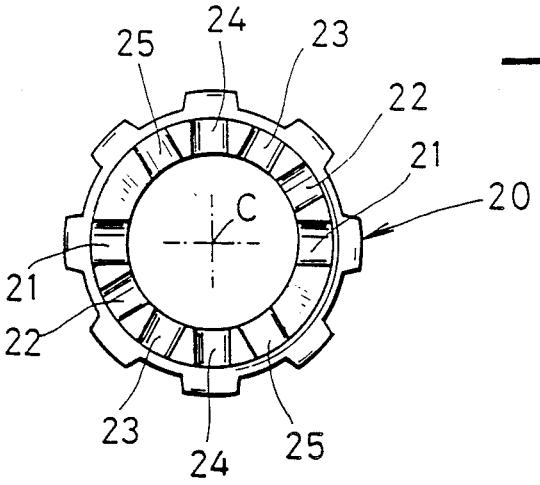
FIG. 6.
FIG. 4.
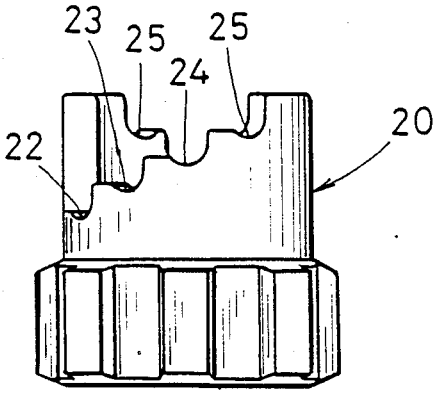
FIG. 5.
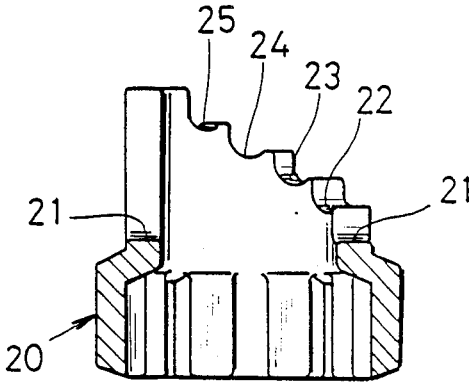

SPRING TENSION ADJUSTMENT AND INDICATOR FOR A HIGH HAT STAND

BACKGROUND OF THE INVENTION

The present invention relates to a high hat stand and particularly to means for adjusting the spring tension on the return spring of the operating shaft of a high hat stand.

In high hat mechanisms for cymbals, a return spring is usually provided on the cymbal operating shaft or on the foot pedal of the high hat stand. The tension of this spring is ordinarily adjustable. In a conventinal mechanism for adjusting the spring tension, one end of the spring is supported by an adjusting member, and the adjustment is carried out by moving the adjusting member.

In a conventional adjustment mechanism however, the state of the adjustment of the spring is not easily ascertainable on the basis of its appearance or that of elements associated with it so that the adjustment of the force of the spring has been difficult to effect or to view. In addition, adjustment based upon the movement of the spring has been complicated.

SUMMARY OF THE INVENTION

The object of the present invention is to adjust the spring tension of a high hat stand in which the level of the tension of the spring can be seen clearly and the adjustment can be achieved by a simple operation.

A cymbal is supported on an operating shaft. The invention adjusts the position of a second member near the shaft, namely an inner tubular member, which surrounds that shaft and supports a spring connected with that shaft for adjusting spring tension on that shaft. The inner tubular member is moved to move the spring. The level of the spring tension is indicated by visual reference to the position of an engagement member on the inner tubular member.

The engagement member on the inner tubular member protrudes outwardly from a vertical slot in a surrounding outer tubular member.

An adjustment member having a plurality of different height steps is rotatable on the outer tubular member. A selected height step is engaged by the engagement member to change the height of the inner tubular member and thereby change the tension of the spring for the operating shaft.

BRIEF DESCRIPTION OF THE DRAWINGS

The foregoing and other objects and features of the invention will be apparent in the following description and drawings in which:

FIG. 4 is a side view of the adjustment member.

FIG. 5 is a vertical cross-sectional view of the adjustment member.

FIG. 6 is a plan view of the adjustment member..

DESCRIPTION OF THE PREFERRED EMBODIMENT

Figure 1:
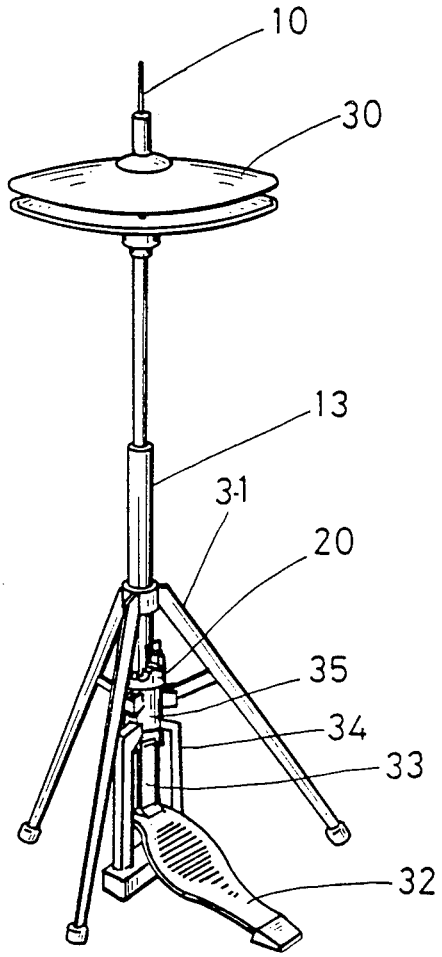
FIG. 1 is a view in perspective of a high hat stand in accordance with the present invention.

FIG. 1 shows a complete high hat stand comprised of a cymbal 30, a cymbal operating shaft 10, inner tubular member 12 around the shaft 10 and movable longitudinally for adjusting spring tension, an outer tubular member 13 surrounding the inner tubular member 10 and supported nonshiftably by three legs 31 and a foot pedal 32 connected through a connecting member 33 at the lower part of the operating member 10. An adjustment mechanism 20 in accordance with the invention is provided below the outer tubular member 13. A frame 34 for the foot pedal 32 also supports the end 35 of the tubular member 13.

Figure 2:
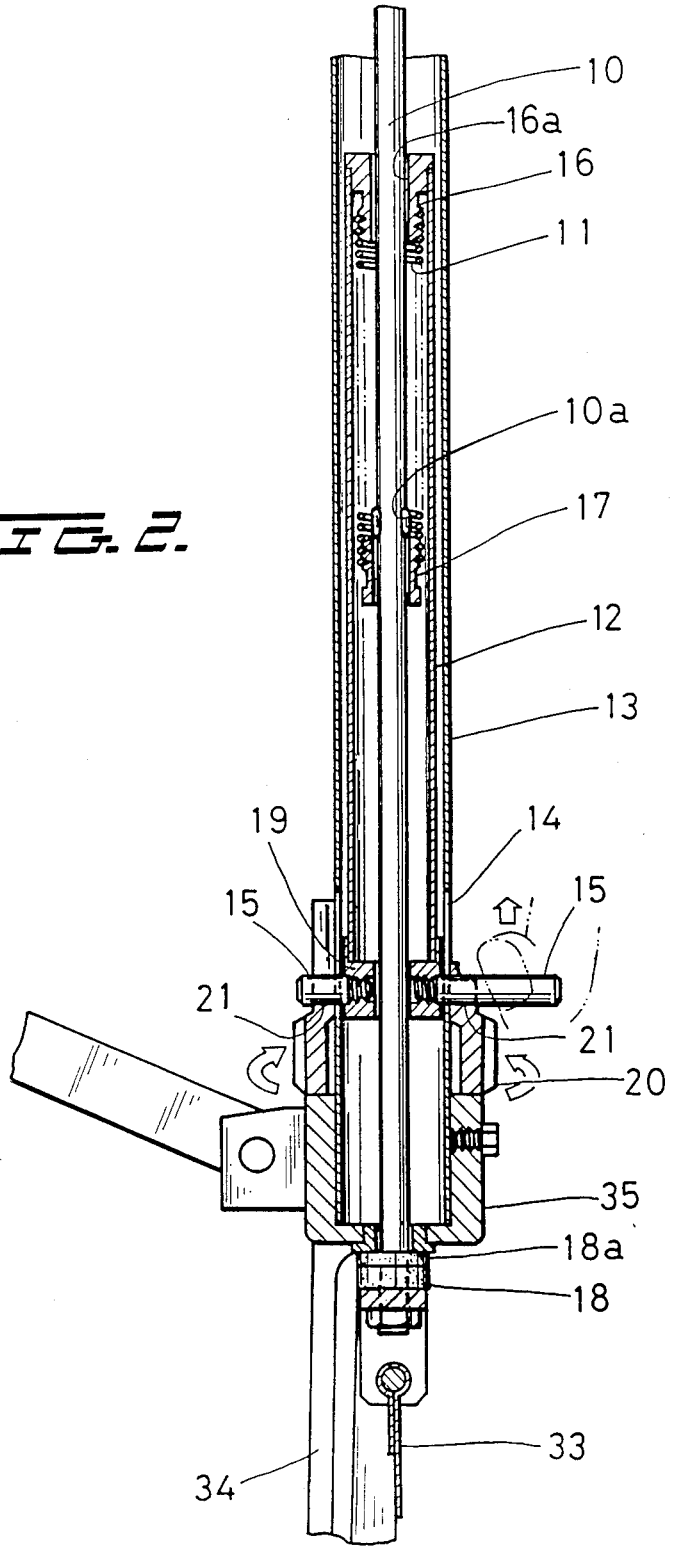
FIG. 2 is a vertical cross-section of essential elements of the adjustment mechanism.

In FIG. 2, the cymbal operating shaft 10 is normally biased upwardly to raise the cymbal by tension spring 11. An upper spring holder provided at the upper end of the inner tubular member 12 supports one end of the spring. The holder 16 has a free passage hole **16*a* for the inner member 10**.

The lower end of the spring 11 is supported on a lower holding member 17 which engages the plane part **10*a* on the shaft 10. The member 17 is positioned so that the shaft 10 is upwardly biased by the spring 11. Stopper 18 sets the upper limit of the upward movement of the shaft 10 by contacting a cushion stop 18*a* on the under side of frame 34, 35**.

Figure 3:
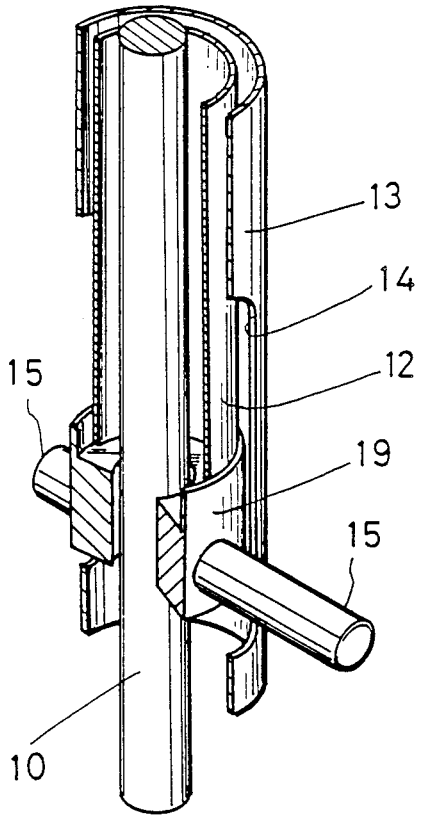
FIG. 3 is a broken away, perspective view of the adjustment member for vertical adjustment of the inner tubular member with respect to the outer tubular member.

Round engagement rods 15 at opposite sides of and on the lower end of the inner tubular member 12 protrude outwardly through respective, oppositely positioned longitudinal slots 14 that pass through and extend longtudinally along the outer tubular member 13, as shown in FIGS. 2 and 3. The engagement rods extend in a straight line from the sides of the cylindrical member 19 that is provided at the lower end of the inner tubular member 12. The engagement rod 15 may be grasped more easily if one of them is longer, as shown in FIG. 2.

The outer tubular member 13 carries on its exterior at its lower end an adjustment member 20 which is freely rotatable on the stationary brim or end member 35 as shown in FIG. 2. Alternately, a brim may be integrally formed on the outer tubular member 13 to support the adjustment member.

As shown in FIGS. 4, 5 and 6, the adjustment member 20 has a plurality of steps, shown as five steps 21, 22, 23, 24 and 25, of different heights that may be selectively engaged with the engagement members 15. The top of each the step is arc shaped to receive the round shape of the engagement rods 15. In addition, the steps are so placed and of such heights that pairs of steps of the same height are formed on opposite sides around the outer periphery, each to receive the pair of engagement members 15 on opposite sides of the inner member 12. The number of steps is obviously not limited to five. Other step arrangements may be provided for ease of adjustment depending on the axial length and the diameter of the engagement member 15 and providing more or fewer of the steps.

Rotation of the adjustment member 20 to different rotative orientations moves the steps to adjust the height of the engagement members 15, which moves the inner tubular member 12 with respect to the outer tubular member 13, which is why the slots 14 are provided, and also moves the inner tubular member with respect to the operating shaft 10, which is held stationary at the stop 18. This, in turn, changes the tension on spring 11.

Also, the spring drives the inner tubular member down as it biases the operating shaft up.

In the utilization of the high hat stand spring tension adjustment member which has been described above it becomes easy to tell the level of spring tension from the visible location of the engagement members 15 along the outer tubular member 13. It is also easy to carry out an adjustment by the simple operation of changing the steps 21–25 which are engaged by the engagement members 15. This improves the ease of handling and adjustment. There is no need for utilizing parts requiring precision working screw mechanisms and the cost and operations with respect to quality control and assembly of a finished product as well as the manufacturing costs can be held lower.

In the foregoing the present invention has been described in connection with an illustrative embodiment. Since many variations and modifications of the invention will now be obvious to those skilled in the art, it is preferred that the scope of this invention be determined, not by the specific disclosure herein contained, but only by the appended claims.

What is claimed is:

1. Means for adjusting the spring tension in a high hat stand comprising:

an operating shaft for supporting a cymbal of the high hat stand;

a first spring support on the shaft;

a second element near the shaft; a second spring support on the second element;

a spring extending between the first and second spring supports, and the spring supports being so placed and the spring being of a type to urge the operating shaft to raise the cymbal;

an engagement member attached to and protruding outwardly from the second element;

an adjustment member having a plurality of steps of different heights measured longitudinally of the second element and being supported with respect to the second element, the adjustment member being relatively movable with respect to the engagement member to bring a selected step to the engagement member for the engagement member to be supported on the selected step for moving the engagement member to different heights by relative movement between the adjustment member and the engagement member, and movements of the engagement member to different heights moving the second element for adjusting the spring tension of the spring.

2. The high hat spring tension adjustment means of claim 1, wherein the second element comprises an inner tubular member around the shaft.

3. The high hat spring tension adjustment means of claim 2, wherein the adjustment member is supported to extend around the inner tubular member and is rotatable around the inner tubular member and with respect to the engagement member for bringing different selected steps to the engagement member.

4. The high hat spring tension adjustment means of claim 3 further comprising an outer tubular member disposed around and nonmovable in the longitudinal direction with respect to longitudinal movement of the inner tubular member caused by the engagement member; the outer tubular member having a longitudinally extended slot therethrough and the engagement member projecting through the slot and externally of the outer tubular member;

the adjustment member is supported at and is freely rotatable with respect to the outer tubular member and the slot through the outer tubular member prevents rotation of the engagement member during the rotation of the adjustment member past the engagement member, whereby the engagement member is moved to various height positions by the adjustment member through rotation of the adjustment member with respect to the engagement member and the outer tubular member.

5. The high hat spring tension adjustment means of claim 3, wherein the spring is normally tensioned in a direction which tends to move the engagement member downwardly and downwardly against the steps of the adjustment member.

6. The high hat spring tension adjustment means of claim 5, further comprising cooperating stoppers on the operating shaft and on the outer tubular member for permitting upwardly directed, spring tension caused movement of the operating shaft to a predetermined extent and for thereafter halting that movement of the operating shaft.

7. The high hat spring tension adjustment means of claim 5, further comprising a manually operable element connected with the operating shaft for being operated for moving the operating shaft downwardly against the tension of the spring, and upon release of the manually operable means, the spring being directed to return the operating shaft upwardly.

8. The high hat spring tension adjustment means of claim 7, wherein the manually operable means comprises a foot pedal connected with the operating shaft, such that when the foot pedal is depressed, the operating shaft moves downwardly further tensioning the spring.

9. The high hat spring tension adjustment means of claim 5, wherein the adjustment member comprises a rod of a perdetermined cross-section and each of the steps includes a depression therein of complementary cross-section.

10. The high hat spring tension adjustment means of claim 9, wherein the adjustment member comprises a rod of circular cross-section and the steps comprise complementary shaped depressions.

11. The high hat spring tension adjustment means of claim 5, wherein the adjustment member steps comprise a series of steps of gradually increasing height in sequence around the adjustment member.

12. The high hat spring tension adjustment means of claim 5, wherein the engagement member comprises a rod projecting sufficiently outwardly of the outer tubular member for providing a visible indication of the height of the engagement member and thus of the spring tension.

* * * * *